US005728010A

United States Patent [19]

Hsu

[11] Patent Number: 5,728,010

[45] Date of Patent: Mar. 17, 1998

[54] GOLF CLUB HEAD IMPROVED IN ITS CENTER OF GRAVITY

[76] Inventor: Tsai-Fu Hsu, No. 386, Liao Ning 1st Street, San Min District, Kaohsiung, Taiwan

[21] Appl. No.: 802,850

[22] Filed: Feb. 19, 1997

[51] Int. Cl.[6] ..... A63B 53/04

[52] U.S. Cl. ..... 473/324; 473/349

[58] Field of Search ..... 473/324–350, 473/287, 288, 289, 290, 291, 292, 256

[56] References Cited

U.S. PATENT DOCUMENTS

| | | | |
|---|---|---|---|
| 1,525,148 | 2/1925 | Pickop | 473/349 |
| 1,866,615 | 7/1932 | Beckley | 473/349 |
| 2,007,377 | 7/1935 | Link | 473/350 |
| 2,683,036 | 7/1954 | Klein | 473/349 |
| 3,059,926 | 10/1962 | Johnstone | 473/291 |
| 3,079,157 | 2/1963 | Turner | 473/350 |
| 4,211,416 | 7/1980 | Swanson | 473/349 |
| 4,607,846 | 8/1986 | Perkins | 473/336 |
| 4,795,157 | 1/1989 | Bencrisaltto | 473/251 |
| 5,193,805 | 3/1993 | Solheim | 473/291 |
| 5,211,401 | 5/1993 | Hainey | 473/340 |

*Primary Examiner*—Sebastiano Passaniti
*Attorney, Agent, or Firm*—Morton J. Rosenberg; David I. Klein; Jun Y. Lee

[57] ABSTRACT

A golf club head improved in its center of gravity has its center of gravity of the face arranged to be located at a point of more than a half height of the face.

1 Claim, 2 Drawing Sheets

GOLF CLUB HEAD IMPROVED IN ITS CENTER OF GRAVITY

BACKGROUND OF THE INVENTION

This invention relates to a golf club head, particularly to that used for hitting a golf ball fallen in a bunker, a sand trap or a beach and having the center of gravity of the face made to be located at a point preferably of more than a half height of the face so as to furnish the golf club head with stability and ball control in hitting a golf ball.

When a golfer hits a golf ball 40 in a bunker, a tall grass area or a sand trap, the person commonly uses a club head called an iron club head for hitting it out thereof, forcing it to fly up. A known conventional golf club head 10 shown in FIG. 3 with the center of gravity 30 located at a bottom is usually used to attain such an object. The center of gravity 30 of a face 20 of the club head 10 is made to be located below ½ of the height of the face 20, or ⅗ of the height of the face 20 by some makers. In adjusting the sight, a golfer places the bottom of the club head 10 behind a ball 40 separated for a distance of a diameter or half diameter of the ball 40, with the face 20 of the club head 10 inclined 60 to the ground. Then the golfer swings the club to hit the ball upward with a little sand or soil dug off together, as shown in FIG. 4, not directly hitting the ball.

Generally speaking, the lower the center of gravity of a club head is, the less the club head 10 sways. However, common golfers neglect a drawback that a club head of the low center of gravity has. As the lower the center of gravity of a club head is, the larger the dimensions of the bottom of a club head is. Then the resistance that the bottom of a club head receives against the bunker 50 will be larger, offsetting a part of the force of hitting a bail. Consequently, the golfer may be impossible to hit the ball to an estimated fall point he/she intends. This is the drawback of the conventional golf club heads for hitting a ball in a bunker.

SUMMARY OF THE INVENTION

The purpose of the invention is to offer a golf club head improved in its center of gravity, which is arranged to be located at more than a half height of the face of a club head.

BRIEF DESCRIPTION OF DRAWINGS

This invention will be better understood by referring to the accompanying drawings, wherein.

DESCRIPTION OF THE PREFERRED EMBODIMENT

Figure 2:
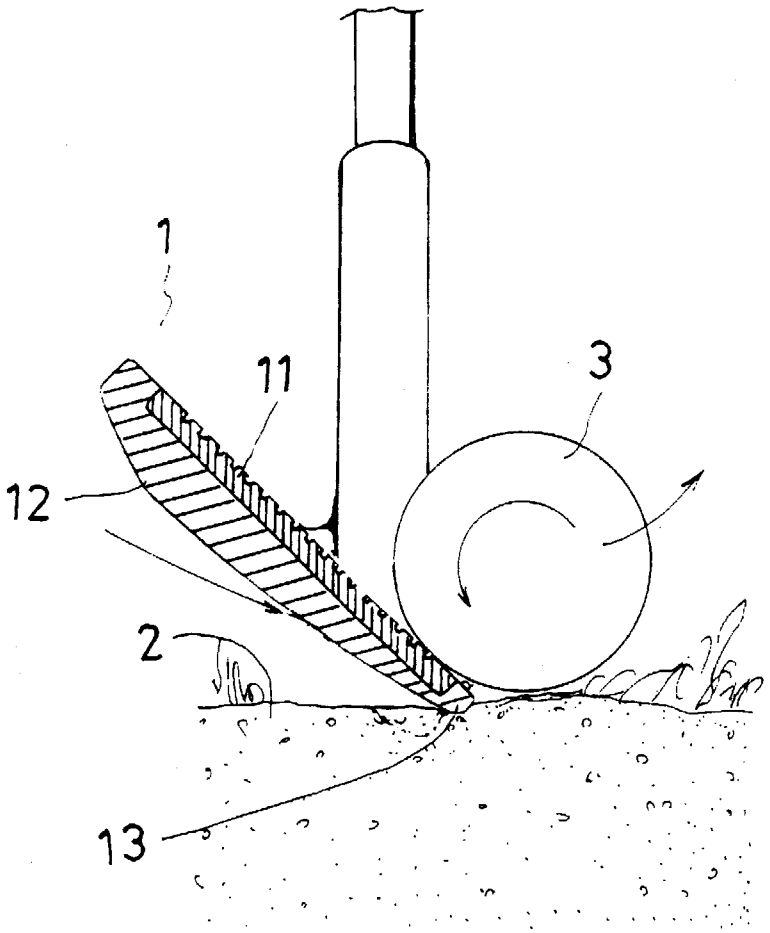
FIG. 2 is a side view of the golf club head in the present invention, showing its position just before hitting a ball.
Figure 1:
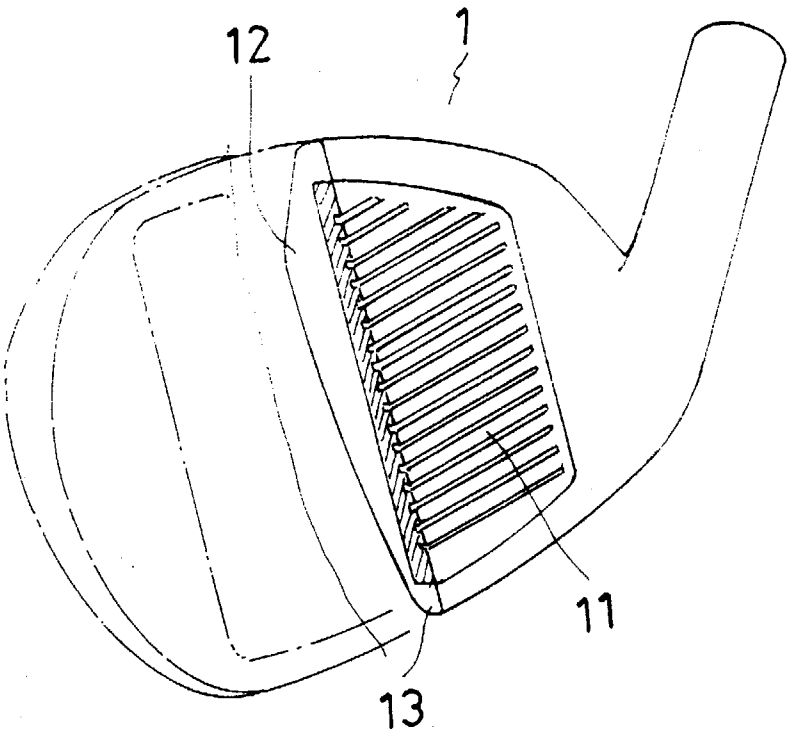
FIG. 1 is a rear view of a golf club head improved in its center of gravity in the present invention.
Figure 4:
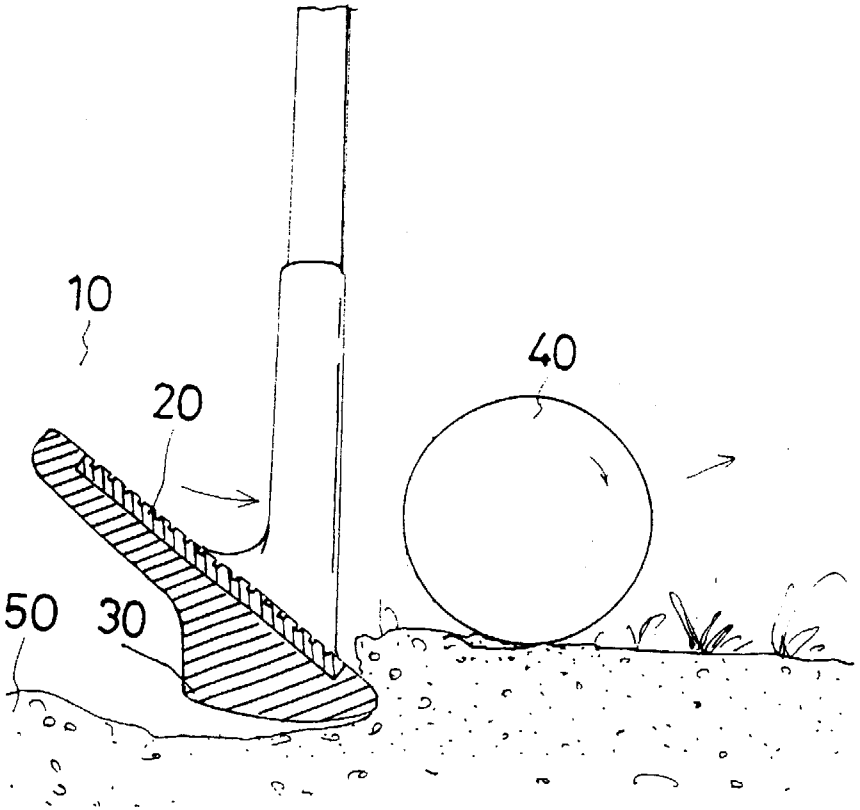
FIG.4 (PRIOR ART)
FIG. 4 is a side view of the known conventional golf club head, showing its position just before hitting a ball.
Figure 3:
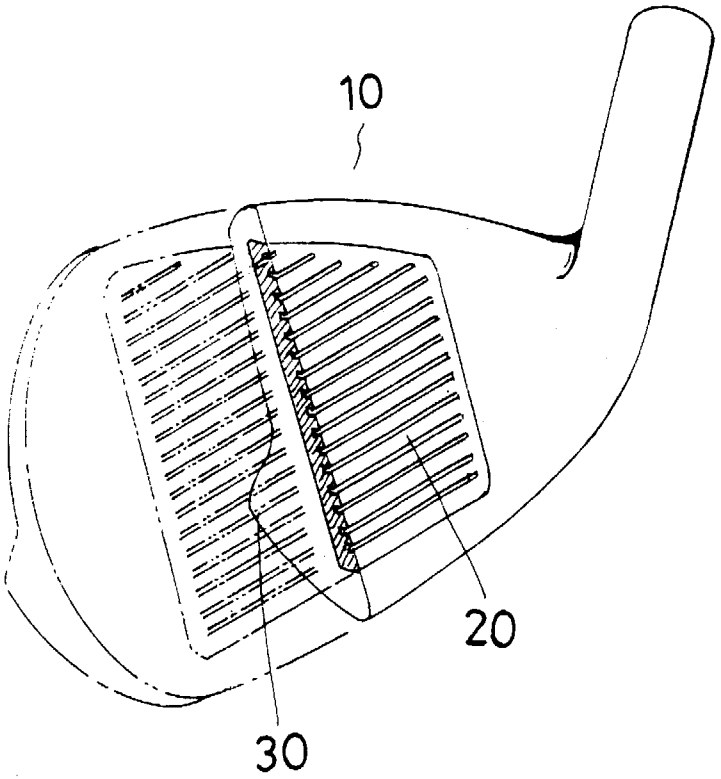
FIG.3 (PRIOR ART)
FIG. 3 is a rear view of a known conventional golf club head.

A preferred embodiment of a golf club head improved in its center of gravity in the present invention, as shown in FIG. 1, has a body 1, a face 11 for hitting a ball, and the center of gravity 12, which is arranged to be located higher than that conventional golf club heads have. In the invention, the center of gravity 12 is designed to be higher than half the height of the face 11. Then the dimensions of the bottom 13 of the club head 1 becomes less to touch the surface of a sand trap 2, or a a green. Consequently, the resistance of the bottom 13 against the sand trap or the bunker 2 becomes less. When a golfer wants to hit a ball 3 fallen on the sand trap 2 (or a tall grass area or a sand green), he/she moves the face 11 of the head 1 behind the ball 3, with the face 11 inclined about 60 to the ground so as to let a hitting point of the face 11 on the ball 3 located different from that of the face of a conventional club head. In other words, the center of gravity 12 of the club head 1 is a little higher than the center of gravity of the ball 3. So the head 1 can directly hit the ball 3 out, and the hitter can estimate hitting force to hit the ball 3 to an expected fall point, forcing the ball 3 to fly in a high parabolic route and fall on the expected fall point. Thus, a golfer can save a ball fallen in a sand trap 2 with the golf club head 1 of the invention, with a fall point of the ball 3 estimable by a golfer, as the golf club head 1 has a better function of ball control and better gripping stability than conventional ones.

The golf club head according to the present invention has the following advantages.

1. When it hits a ball, it can bit the bottom of a ball to force it to fly upward in a high parabolic route to fall on the ground and to roll forward for a less distance than conventional golf club heads of a low center of gravity do, and then a fall point of a ball may be estimated to be more correct.

2. It can permit the face to hit the center of gravity of a ball in a sand trap without hitting sand in the sand trap with the ball together in hitting as traditional golf club heads have to do.

3. It can bit a ball to fly rotating backward in a ballistic route, preventing the ball from rolling forward with excessive inertia after it falls down on the ground.

While the preferred embodiment of the invention has been described above, it will be recognized and understood that various modifications may be made therein and the appended claims are intended to cover all such modifications which may fall within the spirit and scope of the invention.

What is claimed is:

1. An iron-type golf club head for hitting a golf ball from a sand trap, comprising a body extending outwardly from a connection to a golf club shaft and an inclined ball striking face formed on a front side thereof for lofting a golf ball struck therewith, said body having an upper portion extending to a top edge thereof and a lower portion extending from a bottom edge of said body, said lower portion of said body having a thickness continuously increasing from a minimum at said bottom edge to a maximum at said upper portion for providing a center of gravity above an upper half of said ball striking face while minimizing contact with a surface portion of the sand trap, said maximum thickness being at a location between said top edge and a position intermediate said top and bottom edges.

* * * * *